US007341176B2

(12) United States Patent
Lundström et al.

(10) Patent No.: US 7,341,176 B2
(45) Date of Patent: Mar. 11, 2008

(54) METHOD OF TYING TWO OR MORE COMPONENTS TOGETHER

(75) Inventors: Dennis Lundström, Göteborg (SE); Joachim Lindqvist, Göteborg (SE)

(73) Assignee: Volvo Aero Corporation, Trollhattan (SE)

( * ) Notice: Subject to any disclaimer, the term of this patent is extended or adjusted under 35 U.S.C. 154(b) by 43 days.

(21) Appl. No.: 10/707,185

(22) Filed: Nov. 25, 2003

(65) Prior Publication Data

US 2004/0164124 A1 Aug. 26, 2004

Related U.S. Application Data

(60) Provisional application No. 60/428,916, filed on Nov. 26, 2002.

(51) Int. Cl.
*B23K 31/00* (2006.01)
*B23K 9/00* (2006.01)

(52) U.S. Cl. ..... 228/138; 228/139; 228/245; 219/127

(58) Field of Classification Search ..... 228/135, 228/138, 139, 140
See application file for complete search history.

(56) References Cited

U.S. PATENT DOCUMENTS 2,181,550 A * 11/1939 Haupt ..... 428/594
2,957,237 A * 10/1960 Regle et al. ..... 228/136
3,477,115 A * 11/1969 Martin et al. ..... 228/114.5
3,747,466 A * 7/1973 Rosman ..... 411/361
3,854,030 A * 12/1974 Roye ..... 219/72
3,878,356 A * 4/1975 Roye ..... 219/150 V
5,111,570 A * 5/1992 Baumgarten et al. .... 29/402.13
5,116,691 A 5/1992 Darolia et al.
6,460,750 B1 * 10/2002 Coletta et al. ..... 228/2.1
6,769,595 B2 * 8/2004 Stol et al. ..... 228/112.1
2003/0218052 A2 * 11/2003 Litwinski ..... 228/112.1

FOREIGN PATENT DOCUMENTS

JP 355027455 * 2/1980
JP 355027457 * 2/1980
JP 10-205510 A * 8/1998

OTHER PUBLICATIONS www.m-w.com Merriam-Webster Online Dictionary.*
E.P. George, et al.; "Ordered Intermetallics"; Annu. Rev. Mater. Sci.; 1994; 24:409-51; Annual Reviews Inc.
Gerhard Sauthoff; "Intermetallic Phases-Materials Developments and Prospects"; Z. Metallkde; 1989; pp. 337-344; Bd. 80 H.5; Max-Planck-Institut fur Eisenforschung GmbH, Max-Planck-Str. 1, D-4000 Dusseldorf.
Anthony F. Giamei; "Materials Intermetallics"; Advanced Materials & Processes Jan. 1990; 1977; pp. 74 & 88.
Margaret Hunt; "The Promise of Intermatallics"; ME; Mar. 1990; pp. 35-39.

* cited by examiner

*Primary Examiner*—Kiley Stoner
(74) *Attorney, Agent, or Firm*—Novak Druce + Quigg LLP

(57) ABSTRACT

Method of tying two or more components together using a fastener. Each component is provided with a hole and the components are placed so that the holes overlap one another in order to receive the fastener in the holes. The fastener is placed in the holes and mechanically pressure-loaded and heated in order to deform the fastener to tie the components together. The fastener is heated essentially only during the fastener deformation phase in order to minimize the heat transfer from the fastener to the components being tied.

19 Claims, 2 Drawing Sheets

METHOD OF TYING TWO OR MORE COMPONENTS TOGETHER

CROSS REFERENCE TO RELATED APPLICATIONS

The present application claims the benefit of U.S. Provisional Application No. 60/428,916 filed 26 Nov. 2002, the disclosure of which is expressly incorporated herein by reference in its entirety.

BACKGROUND OF INVENTION

1. Technical Field

The present invention relates to a method of tying two or more components together by means of a fastener.

Such a method can be used for the manufacture of a number of products; hereafter, examples will be described, and that are intend to in no way be restrictive with respect to the invention, as to how the method can be applied in order to tie a number of components together in a way that those components form a cohesive and self-supporting construction with a view toward joining the components together in an additional way, for example by soldering, at a subsequent stage of manufacture.

2. Background

In the aircraft industry, for example, there is a need to join various components, such as plates or panels, together by soldering and other appropriate tying methods, for the manufacture of various articles (constructions). In order to facilitate the soldering of a number of plates, the components must be fixed in relation to one another during the soldering phase. A fixture, or a so-called soldering jig, can be used for this purpose. If the construction comprises (includes, but is not limited to) a large number of components, however, or if the construction has a complex geometry, great demands will be placed on the design of the soldering jig. In addition to the fact that the complexity of the soldering jig leads to high production costs, it will also often be difficult to handle at the soldering stage.

One way of dispensing with the use of a soldering jig is to instead preassemble the plates or components into a self-supporting construction prior to soldering. Such preassembly can be achieved by welding or riveting the components together. When using brittle materials, however, such as intermetallic alloys, for example TiAl, NiAl and FeAl, conventional soldering, welding and riveting can have an adverse effect on the material and on the characteristics of the finished product, due to the occurrence of cracking.

For TIG and EB welding of intermetallic alloys, a complicated preheating and/or postheating of parts of the construction, or the entire construction are required in order to avoid cracking and/or expansion in the weld seam or the parent material as a result of large temperature gradients. Both the process and the equipment needed to carry out such heat treatments are expensive.

Conventional hot-riveting can also lead to large temperature gradients in the construction that results in cracking. Furthermore, riveting with rivets made of conventional material, such as IN600 or the like, can lead to thermal fatigue cracking due to large differences in the coefficient of thermal expansion between the material in the rivet and the material in the components made from intermetallic compounds that are to be riveted together. At higher temperatures, differences in the thermal expansion of the materials will have an effect on the force with which the rivet holds the components together. If the rivet has a higher coefficient of thermal expansion than the components that are held together by the rivet, at higher temperature, the force with which the components are held together will be reduced. In addition, alloys of different composition in rivets and plates lead to the formation of undesirable brittle phases in the material closest to the rivet hole during subsequent soldering of the components, for example.

SUMMARY OF INVENTION

An object of the present invention is to provide a method of the type described in the BACKGROUND above and in which at least one of the aforementioned disadvantages of known relevant tying methods is substantially mitigated. That is to say, an object of the invention is to provide a method of tying components together by means of a fastener, by which method even particularly brittle materials can be tied together without undue adverse effects on the material in the form of cracking or the formation of undesirable brittle phases in the material.

According to the invention, this object is achieved at least in part by the fastener being essentially heated only during the deformation phase of the fastener. This minimizes the heat transfer from the fastener to the components that are to be tied together. Heat only has to be supplied to the fastener and only to the extent needed to deform the fastener to the required degree under the relevant load. This in turn means that the components to be so tied together can be kept at a relatively low temperature, without large temperature gradients, and that the characteristics of the material of the components can remain largely unaffected during tying. In this way, it is also possible to make efficient use of the quantity of energy used for tying purposes.

An important advantage of the present inventive method is that it is possible to use non-preheated components and non-preheated fasteners in the tying process. Prior to tying, the components and the fastener may be at ambient temperature, such as normal room temperature, or a temperature close thereto. This makes it possible to dispense with costly processes and devices previously required for the heat treatment of components prior to and/or after tying, while the tying process can be carried out without significant adverse effects on the components.

In a preferred embodiment of the inventive method, the fastener is first pressure-loaded and then heated while the pressure loading is maintained. In this way the initiation of the fastener deformation sequence can be controlled with the supply of heat to the fastener. Exemplarily, the heat can be suitably applied or obtained by passing an electrical current through the fastener. The use of electrical current for transferring to, or generating heat the fastener has the advantage that it is relatively easy to control; that is to say, the strength of the current and the time for which the current must flow through the fastener can be adjusted to the relevant material and dimensional parameters of the construction in order to produce the required heating.

In a further preferred embodiment of the invention, the fastener is pressure-loaded by means of a tool, and after deformation of the fastener, the mechanical contact between the pressure loading tool and the fastener is maintained to allow cooling of the fastener through the transfer of heat from the fastener to the pressure loading tool. The excess heat present in the deformed fastener can thereby largely be absorbed by the pressure loading tool, which can be cooled in order to promote such heat transfer, and the undesirable transfer of heat to the components being tied by the fastener can in this way be further reduced.

A suitable tool for carrying out the tying together of components according to the teachings of the invention is a combined pressure loading and heating tool that has two electrodes. The fastener is placed between the two electrodes, and via the electrodes, a pressure is applied to the fastener while heat is generated in, or delivered to the fastener by an electrical current flowing between the electrodes during the fastener deformation phase. Heat can furthermore be dissipated from the fastener following the deformation phase by the electrodes having a lower temperature than the fastener and remaining in contact therewith.

The invention also relates to a rivet made from an intermetallic alloy for tying together two or more components made from intermetallic alloys.

The invention further relates to an aircraft component manufactured using the presently disclosed method(s) in which a product having two or more intermetallic alloy components is joined together by soldering and which has one or more intermetallic alloy rivetings. The product is derived from a tying of the component-parts by means of the present inventive method prior to the soldering together of the components. The pre-tying together of the components is performed in order to keep the parts substantially fixed with respect to one another during the soldering process. The use of a inventive method can be utilized in order to create at least a temporary tying of one or more components thereby forming a unit that enables the performance of a subsequent treatment such as soldering of the unit, for example.

BRIEF DESCRIPTION OF DRAWINGS

Preferred embodiments of the invention will be described below, by way of example, and with reference to accompanying drawings in which.

DETAILED DESCRIPTION

Figure 3:
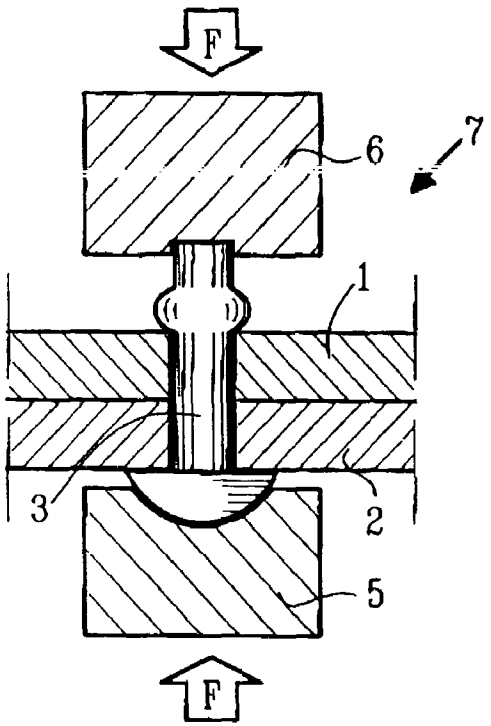
FIG. 3 is a schematic cross-sectional view corresponding to FIG. 1, and illustrating, after removal of the voltage deformation of the fastener has been effected, while maintaining contact between the fastener and the electrodes.

The inventive method of the present invention will now be described in more detail with reference to FIGS. 1-4. Therein, two or more components 1, 2 that are to be tied together are provided with a through hole (one in each component) and the components 1, 2 are positioned so that the holes in the components overlap one another in order to receive a fastener 3 in (through) the apertures. The fastener 3 has longitudinal extent (a length) exceeding the total thickness of the components 1, 2, so that a part 4 of the fastener protrudes outside the holes and the components, and the fastener 3 is thus exposed for deformation; that is, for being compressed towards the nearest component 1, 2 with simultaneous expansion of the cross-section of a part or portion 4 of the fastener 3. The fastener 3, after being placed in the holes, is mechanically pressure-loaded and heated in order to deform the fastener 3 as shown in the series of FIGS. 1-2 thereby tying the components 1, 2 together.

In the method according to invention, the fastener 3 is heated essentially only during the fastener deformation phase in order to minimize the heat transfer from the fastener 3 to the components 1, 2 to be tied. The expression "essentially only during the fastener deformation phase" is utilized to signify that heat is not supplied before or after the deformation of the fastener in order to produce the tie. The fastener 3 is therefore not preheated when being placed in the holes in the components and no preheating in the conventional sense occurs prior to the deformation phase. Further, nor do the components 1, 2 need to be preheated. As will be apparent from the following description, however, a certain heat transfer to the fastener 3 may occur prior to deformation, owing to the fact that the deformation does not occur instantaneously when heat is supplied to the fastener, but a certain delay can occur between the supplying or generation of heat and deformation. Similarly, a certain amount of heating can occur just after deformation due to hysteresis in the system. The aim, however, is to minimize heat transfer to the fastener 3 and hence to the components 1, 2 after deformation of the fastener has been carried out.

Figure 1:
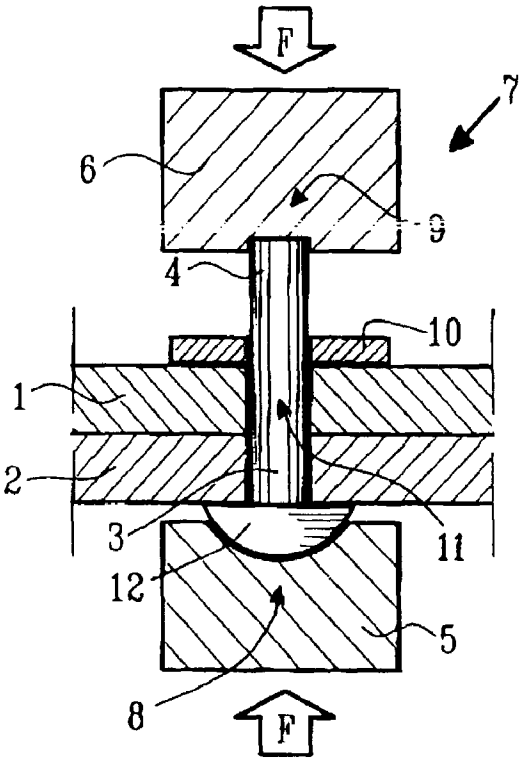
FIG. 1 is a schematic cross-sectional view illustrating how a fastener for tying two components together is pressure-loaded by means of two electrodes.

FIG. 1 shows how a rivet 3 for tying two plates 1, 2 together is loaded. A load, F, that is sufficient to deform the rivet 3, in the hot state, is applied to the fastener 3 by, for example, two moving electrodes 5, 6 that create a combined pressure loading and heating tool 7. The two electrodes 5, 6, are oriented in a straight line relative to one another and move towards one another with the rivet 3 arranged therebetween. One of the electrodes 5 can be suitably fixed and accommodate a headed end 8 of the rivet 3, for example, while the other electrode 6 is designed for rectilinear movement towards (and away from) the other end 9 of the rivet and the first electrode 5. Alternatively, both electrodes 5, 6 can be designed for rectilinear movement.

Figure 2:
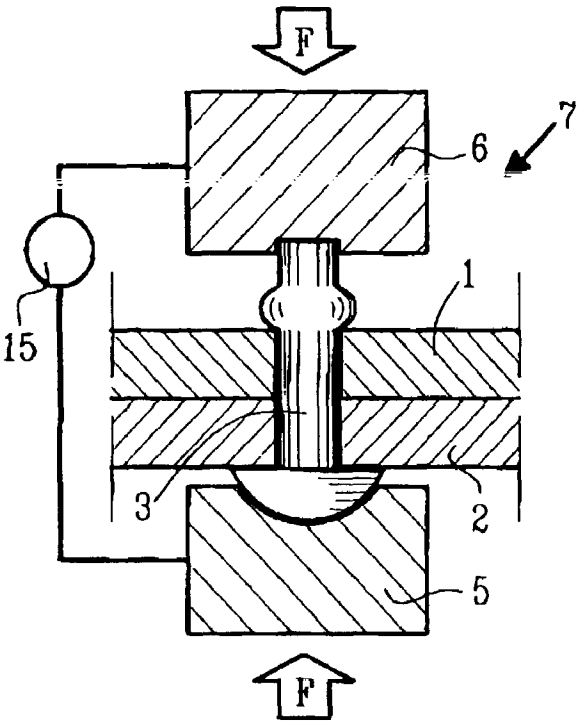
FIG. 2 is a schematic cross-sectional view corresponding to FIG. 1, and illustrating a voltage being applied over the fastener to facilitate deformation of the fastener.

FIG. 2 shows how in a subsequent stage, by means of a voltage source 15, an electrical voltage is applied over the electrodes 5, 6 and thereby over the rivet 3. This involves passing a current through the pressure-loaded rivet 3 so that the rivet is heated, with the result that the rivet 3 is deformed due to the pressure loading and the increased temperature of the rivet. Following, the current is immediately withdrawn and the heat supply (generation) to the rivet 3 ceases. Due to the fact that a certain delay can occur between the application of current and the generation of heat in the rivet 3, the current supply may in certain cases have to be cut off before complete deformation has occurred in order to avoid undue heating of the rivet 3. The current strength and the duration of the current are naturally adjusted to the different conditions prevailing during the actual riveting operation; such conditions including the dimensions and material of the rivet 3, which in turn depend on the material and dimensions of the plates 1, 2. The duration of the current exemplarily ranges from fractions of a second, up to about one second. With regard to the voltage source 15, it is possible to use both an alternating current voltage source or a direct current voltage source in order to generate the required current.

Thereafter, as shown in FIG. 3, the load on the rivet 3 can be maintained, or at least the mechanical contact between the electrodes 5, 6 and rivet 3 can be maintained even if the load, F, is reduced or removed in order to cool the rivet 3. The electrodes 5, 6, can absorb any excess heat in the rivet 3 by transfer to the electrodes rather than to the plates 1, 2 being tied together by the rivet 3. It is advantageous, however, in order to prevent cracking, that the load be maintained during the cooling process. Such cooling of the rivet 3 is typically completed in one to a few seconds. In order to facilitate the transfer of heat from the rivet 3 to the pressure loading tool 7 after deformation of the rivet 3, the pressure loading tool 7 can be cooled by means of conventional equipment. The method, or at least the heating of the fastener 3, is suitably performed in an atmosphere containing an inert gas in order to minimize oxidation of the fastener 3 and/or the components 1, 2. In practice, this will to some degree require that the components 1, 2 to be tied together also be placed in such an atmosphere.

After deformation, that is to say upsetting of the rivet 3, the electrodes 5, 6 and the components 1, 2 can be moved in relation to one another in order, where required, to permit riveting in another position of the components 1, 2 using a further rivet.

If, due to particularly unfavorable geometry and/or unfavorable dimensions there should still be a risk of cracking or of other undesirable effect on the material, the risk can be further reduced by using a protective component 10, in the form of a rivet washer 10, for example. As illustrated schematically in FIG. 1, the rivet washer 10 can be arranged round the rivet 3, at the deformation end 9 of the rivet, and up against one of the components 1. In this way, in subsequent deformation of the rivet 3, direct contact between the hot deformed material of the rivet and the plate 1 will be prevented. This advantageously causes the greatest temperature gradient to be between the rivet 3 and the rivet washer 10, rather than between the rivet 3 and the plate 1.

Figure 4:
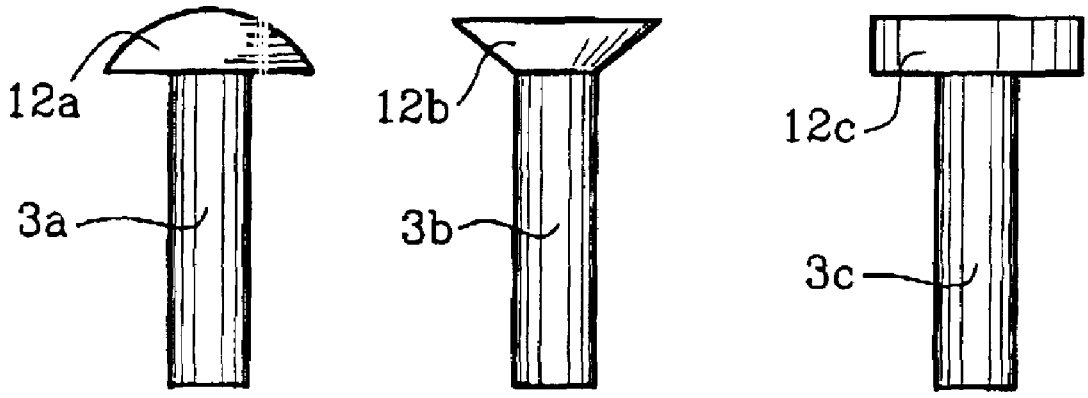
FIG. 4 is a schematic side view of three different examples of fasteners for use in the method of the presently disclosed invention.

The fastener 3 illustrated in FIGS. 1, 2 and 3 may be designed in a number of different ways without departing from the scope of the invention. Although the fastener 3 in the example described above has an elongate section 11 with circular cross-section and a head 12 at one end 8, other embodiments of the fastener are possible. For example, the head 12 might be eliminated even though this in turn requires more advanced riveting equipment in order to control the deformation of the rivet. Should the rivet 3 be provided with a head, this may be designed both for flush riveting and raised riveting. Three examples of different rivets 3*a*, 3*b*, 3*c* having different types of heads 12, 12*b*, 12*c* are illustrated in FIG. 4, of which one rivet 3*b* is designed for flush riveting.

Other conventional equipment can naturally also be used in the performance of, or together with the present inventive method. For example, equipment for pressing the plates together during the riveting operation may be used if so required.

The piercing of holes in the components 1, 2, required for tying them together can be performed by conventional methods such as drilling, spark erosion or water cutting. The shape and size of the holes and the shape and size of the rivet are matched to one another so that the desired riveted connection can be achieved by deformation of the rivet when placed in the holes. Holes and rivets of circular cross-section with substantially the same diameter are preferably used, but it is also possible to use rivets of different cross-sectional shape.

Piercing can be performed simultaneously for the components to be tied, or separately for each component. In order to facilitate joining of the components in a subsequent treatment of the components, a layer of material, such as a soldering foil (not shown) can be arranged between the components before or after piercing the holes. The soldering foil is then used for soldering the components together. By soldering the components together it is possible to obtain a permanent product having a considerably higher load transmission capacity compared to the temporary product simply riveted together.

It should also be added that multiple rivets can be riveted essentially simultaneously through the use of more than one pressure loading tool, or one pressure loading tool that can be applied to a number of rivets at a time; for example, one tool having more than one pair of electrodes.

The method according to the invention is particularly well-suited to tying brittle materials together, such as intermetallic alloys, and rivets of a material from the group of intermetallic alloys are preferably used for this purpose. Examples of alloys in the intermetallic alloys category are TiAl, NiAl and FeAl. Experiments aimed at manufacturing products suitable for use in the aircraft industry using the method according to the invention have successfully been carried out. For example, the method has been applied to plates made of TiAl with a thickness of 1 mm. Rivets made of TiAl are used for tying the plates together and a soldering foil Ticuni 70 with a thickness of 50 μm for soldering the plates together after riveting.

It should be emphasized that the invention is not limited to embodiments of the invention described herein, but only by the claims. Given familiarity with the idea of the invention, a number of modifications within the scope of the invention will be obvious to a person skilled in the art.

The invention claimed is:

1. A method of tying two or more components together by means of a fastener, in which each component is provided with a hole and the components are placed so that the holes overlap one another in order to receive the fastener in the holes, the fastener placed in the holes being mechanically pressure-loaded and heated in order to deform the fastener, thereby tying the components together, wherein the fastener is heated essentially only during the fastener deformation phase in order to minimize the heat transfer from the fastener to the components being tied and tying is carried out with both the fastener and the components made of the same or similar alloys included in the intermetallic alloys group of materials.

2. The method as recited in claim 1, wherein the fastener is first pressure-loaded and then heated while maintaining the pressure loading.

3. The method as recited in claim 1, wherein the fastener is pressure-loaded by means of a tool and mechanical contact between the pressure loading tool and the fastener is maintained after deformation of the fastener in order to cool the fastener by transferring heat from the fastener to the pressure loading tool.

4. The method as recited in claim 3, wherein the pressure loading tool is cooled in order to facilitate heat transfer from the fastener to the pressure loading tool after deformation of the fastener.

5. The method as recited in claim 1, wherein a protective component is arranged at the deformation end of the fastener in order, during deformation of the fastener, to prevent direct contact between the hot-deformed material of the fastener and the component that is arranged nearest to the deformation end of the fastener.

6. The method as recited in claim 1, wherein the components are tied together in a non-preheated state.

7. The method as recited in claim 1, wherein the fastener is applied in the holes in a non-preheated state.

8. The method as recited in claim 1, wherein the fastener is pressure-loaded and heated using a combined pressure loading and heating tool.

9. The method as recited in claim 8, wherein the fastener is pressure-loaded between two electrodes of the combined pressure loading and heating tool.

10. The method as recited in claim 1, wherein the fastener is heated by passing an electrical current through the fastener.

11. The method as recited in claim 1, wherein the fastener is heated in an atmosphere containing an inert gas in order to minimize oxidation of the fastener and/or the components.

12. The method as recited in claim 1, wherein prior to deformation of the fastener, a layer of material is arranged between the components in order to join the components together by means of the layer of material in a subsequent process.

13. The method as recited in claim 1, wherein the components are at least temporarily tied together to form a self-supporting construction with the components substantially fixed to one another, before being joined to form an intended load-transmitting construction element at a subsequent stage of manufacture.

14. The method as recited in claim 13, wherein the components are joined by soldering.

15. An article of manufacture joined together by soldering and comprising: at least two intermetallic alloy components soldered together and said components being tied together prior to soldering by an intermetallic alloy rivet, said article being manufactured by a method including tying the components together by means of the rivet and in which each component is provided with a hole and the components are placed so that the holes overlap one another in order to receive the rivet in the holes, the rivet being placed in the holes and mechanically pressure-loaded and heated in order to deform the rivet, and thereby tying the components together, the rivet is heated essentially only during a rivet deformation phase in order to minimize heat transfer from the rivet to the components that are being tied, the components being made of the same or similar alloys included in the intermetallic alloys group of materials.

16. The article of manufacture as recited in claim 15, wherein said article is an aircraft component.

17. The article of manufacture as recited in claim 15 wherein the rivet is made from an alloy selected from the group consisting of TiAl, NiAl and FeAl alloy.

18. The method as recited in claim 13, further comprising creating at least a temporary tying of one or more components forming a unit for performing a subsequent treatment, such as soldering of the unit.

19. A method of tying two or more components together by means of a fastener, in which each component is provided with a hole and the components are placed so that the holes overlap one another in order to receive the fastener in the holes, the fastener placed in the holes being mechanically pressure-loaded and heated in order to deform the fastener, thereby tying the components together, wherein the fastener is heated essentially only during the fastener deformation phase in order to minimize the heat transfer from the fastener to the components being tied, wherein the fastener is heated in an atmosphere containing an inert gas in order to minimize oxidation of the fastener and/or the components, and tying is carried out with both the fastener and the components made of the same or similar alloys included in the intermetallic alloys group of materials.

* * * * *